US008485635B2

(12) United States Patent
Stadler

(10) Patent No.: US 8,485,635 B2
(45) Date of Patent: Jul. 16, 2013

(54) METHOD TO REFRESH THE INK IN NOZZLES OF AN INKJET PRINT HEAD IN AN INKJET PRINTING APPARATUS

(75) Inventor: Christoph Stadler, Dachau (DE)

(73) Assignee: Océ Printing Systems GmbH, Poing (DE)

( * ) Notice: Subject to any disclaimer, the term of this patent is extended or adjusted under 35 U.S.C. 154(b) by 134 days.

(21) Appl. No.: 13/114,528

(22) Filed: May 24, 2011

(65) Prior Publication Data

US 2012/0033016 A1 Feb. 9, 2012

(30) Foreign Application Priority Data

Aug. 4, 2010 (DE) ..... 10 2010 036 839

(51) Int. Cl.
*B41J 2/165* (2006.01)

(52) U.S. Cl.
USPC ..... 347/25; 347/22; 347/74; 347/23

(58) Field of Classification Search
USPC ..... 347/14, 19, 20, 22, 23, 25, 30, 34–36, 347/73, 77, 82
See application file for complete search history.

(56) References Cited

U.S. PATENT DOCUMENTS

| | | | | |
|---|---|---|---|---|
| 6,863,385 | B2 * | 3/2005 | Jeanmarie et al. | 347/77 |
| 2002/0005874 | A1 | 1/2002 | Imai et al. | |
| 2008/0111851 | A1 | 5/2008 | Muhl | |
| 2008/0143781 | A1 | 6/2008 | Inoue et al. | |

FOREIGN PATENT DOCUMENTS

| | | | |
|---|---|---|---|
| EP | 0788882 | B1 | 7/2002 |
| EP | 1923216 | A2 | 5/2008 |
| JP | 60-184851 | A | 9/1985 |

* cited by examiner

*Primary Examiner* — Juanita D Jackson
(74) *Attorney, Agent, or Firm* — Schiff Hardin LLP

(57) ABSTRACT

In a method to regenerate during operation ink in nozzles of at least one inkjet print head operating according to drop on demand in an inkjet print apparatus, nozzles of the print head that generate print dots on a printing substrate are activated such that the nozzles output first ink droplets of a predetermined volume in a direction towards the printing substrate. Nozzles that are not being currently used to generate print dots on the printing substrate are activated such that they output at least one second ink droplet of a smaller volume in comparison to the first ink droplets volume. During at least the outputting of the second ink droplet, a suction flow is generated between the inkjet print head and the printing substrate of such strength that the second ink droplet is deflected so it does not arrive at the printing substrate.

7 Claims, 2 Drawing Sheets

METHOD TO REFRESH THE INK IN NOZZLES OF AN INKJET PRINT HEAD IN AN INKJET PRINTING APPARATUS

BACKGROUND

Inkjet printing apparatuses can be used for single-color or multicolor printing of a printing substrate, for example a single sheet or a belt-shaped recording material made of the most varied materials (for example paper). The design of such inkjet printing apparatuses is known; see for example EP 0 788 882 B1. Inkjet printing apparatuses that operate according to the Drop on Demand (DoD) principle have a print head or multiple print heads with nozzles comprising ink channels, the activators of which nozzles (controlled by a printer controller) excite ink droplets in the direction of the printing substrate, which droplets are directed towards the printing substrate in order to apply print dots there for a print image. The activators can thermally (bubble jet) or piezoelectrically generate ink droplets.

Given an inkjet printing apparatus operating according to the DoD principle, the ink that is used is adapted in terms of its physical/chemical composition to the print head; for example, the ink is adapted in terms of its viscosity. Given low print utilization, not all nozzles of the print head are activated in the printing process; and thus many nozzles are subject to downtimes (print pauses), with the consequence that the ink in the ink channel of these nozzles is not moved. Due to the effect of the evaporation out of the nozzle opening, the danger exists that the viscosity of the ink then varies. This has the consequence that the ink in the ink channel can no longer move optimally and escape from the nozzle. In extreme cases the ink in the ink channel dries completely and clogs the ink channel, such that a printing with this nozzle is no longer possible.

The drying of the ink in the nozzles can be prevented in that a printing from all nozzles takes place within a predetermined cycle. This cycle can be set corresponding to the print utilization. Individual points in the unprinted regions of the printing substrate can thereby be applied, or print dot lines can be printed between print pages. These methods can lead to disruptions in the print image.

Furthermore, the ink volume in the ink channel can be mixed via oscillation in order to achieve a uniform viscosity in the ink channel. This method fails given longer downtimes of the nozzles since only a limited ink volume is provided in the channel.

An inkjet printing apparatus in which ink fog occurring during printing is suctioned away between print head and printing substrate is described in JP 60184851 A. The suction device is arranged so that a suction flow arises between printing substrate and print head, which suction flow is directed perpendicular to the path or flight directions of the ink droplets and carries along the ink fog. The ink fog is suctioned into a suction chamber in which is arranged a filter that filters the ink from the air flow.

From US 2008/0143781 A1 it is known to intermittently activate a cleaning operation in which the nozzles of the print head eject ink droplets. For this the print head is panned from the printing position into a cleaning position, in which cleaning position the emitted ink droplets cannot arrive at the printing substrate but rather arrive in a capture container. The ink fog occurring in the cleaning operation is drawn off with the aid of a suction device. The print head is subsequently panned back into the printing position again.

A printing device with ink fog suction is known from EP 1 923 216 A2. In particular in the cleaning operation—in what is known as a free spray mode—the nozzles of the print head emit ink droplets that are suctioned away with a suction device. The ink fog arising in the cleaning operation is thereby likewise drawn off as well so that no contamination of the printing apparatus can arise. The suction device can also generate such a suction flow at the print head that no contamination of the printing apparatus can arise in the print operation. The suction device can also generate such a suction flow at the print head that, in the print operation, the ink droplets used for printing are barely deflected by the suction flow; in contrast to this, the ink droplets of smaller diameter that form the ink fog are deflected into a suction intake.

SUMMARY

It is an object to specify a method to operate an inkjet printing apparatus operating according to the Drop on Demand principle, in which method the disadvantages illustrated above are substantially avoided (thus a viscosity change of the ink in the nozzles during a printing pause is prevented for these nozzles).

In a method to regenerate during operation ink in nozzles of at least one inkjet print head operating according to drop on demand in an inkjet print apparatus, nozzles of the print head that generate print dots on a printing substrate are activated such that the nozzles output first ink droplets of a predetermined volume in a direction towards the printing substrate. Nozzles that are not being currently used to generate print dots on the printing substrate are activated such that they output at least one second ink droplet of a smaller volume in comparison to the first ink droplets volume. During at least the outputting of the second ink droplet, a suction flow is generated between the inkjet print head and the printing substrate of such strength that the second ink droplet is deflected so it does not arrive at the printing substrate.

DESCRIPTION OF THE PREFERRED EMBODIMENT

Figure 1:
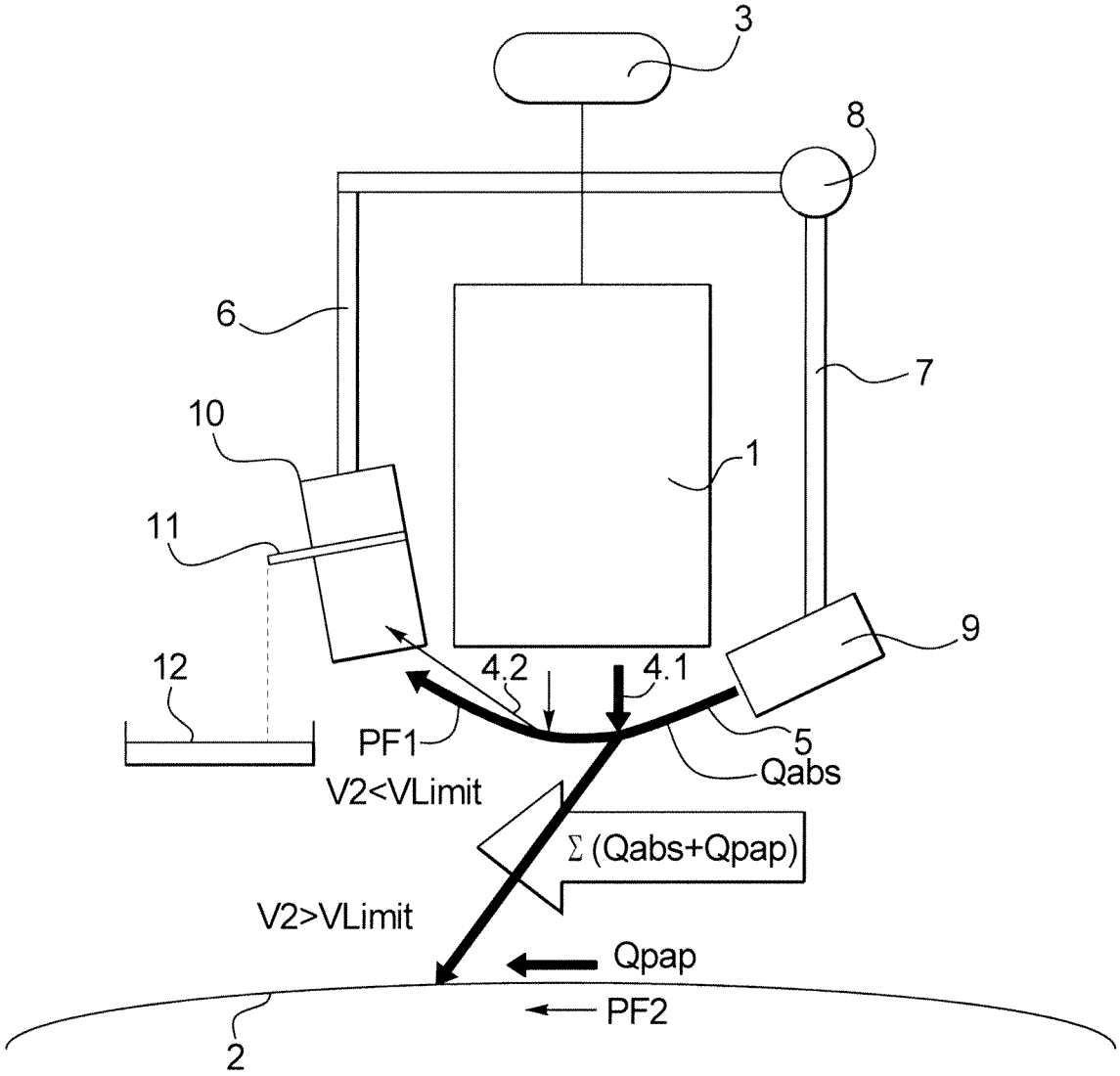
FIG. 1 is a principle representation of a print head of an inkjet printing apparatus with suction device.

For purposes of promoting an understanding of the principles of the invention, reference will now be made to a preferred embodiment/best mode illustrated in the drawings and specific language will be used to describe the same. It will nevertheless be understood that no limitation of the scope of the invention is thereby intended, and such alterations and further modifications in the illustrated embodiment and such further applications of the principles of the invention as illustrated as would normally occur to one skilled in the art to which the invention relates are included.

In a method according to the preferred embodiment, a change of the properties of the ink (for example its viscosity) in the nozzles is prevented since the ink in the nozzles is continuously refreshed. For this the nozzles are activated differently during the printing operation in which a printing substrate is printed, depending on whether a nozzle should generate a print dot on the printing substrate or not. Nozzles that should generate a print dot on a printing substrate are activated so they output ink droplets of a predetermined volume (called first ink droplets in the following explanation) in the direction of the printing substrate. However, in contrast to this nozzles that are not used to generate a print dot on the printing substrate during the running print operation—thus for which a print pause (=downtime) is present—are activated such that during their print pauses they output ink droplets of smaller volume (called second ink droplets in the following explanation) in comparison with the first ink droplets at predetermined time intervals. Between the inkjet print head and the printing substrate a suction flow of such a strength is directed so that only the second ink droplets are deflected and so that these do not arrive at the printing substrate. In contrast to this, due to their larger volume the first ink droplets are not affected by the suction flow so that the print image on the printing substrate is disrupted. The suction flow can be generated by suction of air; it can thus be an air flow. It is advantageous if a continuous and laminar suction flow is directed past the inkjet print head.

The method according to the preferred embodiment therefore has the following advantages.

A complete ink exchange takes place in the nozzles used for the printing. The ink, whose properties could change due to the downtime, is ejected promptly and drawn off and replaced by new ink with the predetermined properties.

During the regeneration of the ink in the nozzles, the ejected ink does not arrive at the printing substrate and does not cause any print image disruptions.

A continuous regeneration of the ink in the nozzles is provided during the print operation. For this, second ink droplets of smaller volume are generated by the unused nozzles while, at the same time, the nozzles with which print dots should be printed on the printing substrate generate first ink droplets with a greater volume that remain largely unaffected by the suction flow. The process of regeneration runs without performance loss in the printing operation. The printing apparatus must neither operate more slowly nor be stopped. In addition to this, no maculature is created since the second ink droplets do not arrive at the printing substrate. This is in particular important in continuous printing apparatuses (continuous feed printing apparatuses) since here the printing substrate is always located under the print head.

The ink that is drawn away in the regeneration can be separated from the air flow and be supplied again to an ink tank that supplies the nozzles with ink; and the ink consumption is therefore reduced.

The preferred embodiment is explained further using the exemplary embodiment shown in the drawing Figures.

FIG. 1 schematically shows an inkjet print head 1 that, in a known manner, has nozzles with ink channels (not shown) that can generate ink droplets according to the DoD principle, which ink droplets are directed towards a printing substrate 2 in order to generate a print dot there. The DoD printing principle is known and therefore is not explained in detail. The print head 1 cooperates with a printer controller 3 that derives activation signals for the individual nozzles of the print head 1 from a data stream that maps the print image. First activation signals that activate the nozzles that should generate a print dot on the printing substrate 2 are derived from the data stream. With these first activation signals the associated nozzles are induced to output first ink droplets of predetermined volume in the direction towards the printing substrate 2. According to the preferred embodiment, second activation signals are supplied to the remaining nozzles that have a print pause (thus are in downtime), which second activation signals induce these remaining nozzles to generate second ink droplets that have a smaller volume in comparison to the first ink droplets, and thereby can be affected so that they do not arrive at the printing substrate 2. The frequency of the second activation signals can be adjusted depending on the operating position. It is selected so that the properties of the ink in the nozzles cannot change during a print pause so as to be undesirable for a later use in the print operation. As an example, in FIG. 1 the path 4.1 of a first ink droplet is drawn strongly extended; and the path 4.2 of a second ink droplet is shown weakly extended.

In order to prevent the second ink droplets from striking the printing substrate 2, a suction device is arranged adjacent to the print head 1, which suction device generates a laminar suction flow 5 between print head 1 and printing substrate 2 that can be continuously maintained. The suction device can have a pump 8 arranged in conduits 6, 7, an overpressure chamber 9 and a suction chamber 10 with a filter 11. The suction chamber 10 can be connected via the conduit 6 with the pump 8 while the overpressure chamber 9 is connected via the conduit 7 with the pump 8. A loop for the suction flow 5 generated by the pump 8 is therefore created. The ink filtered out by the filter 11 can be fed to an ink tank 12 and is then provided for the printing operation again.

The overpressure chamber 9 and the suction chamber 10 are arranged relative to the print head 1 such that the suction flow 5 runs perpendicular to the path of the ink droplets. If the direction of the suction flow 5 coincides with the transport direction of the printing substrate 2, in FIG. 1 it is appropriately indicated by an arrow PF1 for the suction flow 5 and an arrow PF2 for the printing substrate 2.

In the method according to the preferred embodiment the deflection of the ink droplets depending on their volume V or, mass m (due to a continuous, laminar suction flow 5 perpendicular to the droplet flight path 4) is thus utilized in order to draw off ink droplets of lower volume (mass). During the actual printing process a complete regeneration or renewal of the ink in the nozzles via the targeted and defined excitation of ink droplets of low mass is achieved without print image interference on the printing substrate 2. Due to the regeneration the ink in the nozzles maintains constant properties, for example with regard to its viscosity.

In addition to this, the continuous and laminar suction flow 5 in the transport direction of the printing substrate 2 is generated between the print head 1 and the printing substrate 2 using the suction device. Here the air flow Qpap of the printing substrate 2 running in the same direction is added to the suction flow Qabs to form $\Sigma$(Qabs+Qpap). Differentiation is thereby made between two processes running in parallel in the printing operation, the printing process and the regeneration process:

During the printing process the print image is only generated as of a specific limit drop volume VLimit of the ink droplets. This means that although the ink droplets whose droplet volume VI is greater than the limit volume VLimit are slightly deflected by the suction flow 5, they arrive at the printing substrate 2 due to their mass m1 (m1>mLimit).

In contrast to this, the ink droplets that have a volume V2 below the limit volume VLimit are completely deflected by the suction current 5 due to their lower mass m2 (m2<mLimit) and then drawn off (regeneration process).

The limit value VLimit as of which the ink droplet suction occurs can be adjusted via the strength of the suction flow 5 and can thus be adjusted corresponding to the predetermined limit volume VLimit of the print head 1 that is used. The droplet volume of the ink provides the activator (piezoelectrical or thermal) of the print head 1 with its operating voltage. Whether a printing process or a regeneration process should be activated can thus be precisely controlled via the operating voltage. The limit value VLimit is dependent on the print head 1 that is used and is oriented on the volume V of the ink droplet that generates the smallest print image.

The method according to the preferred embodiment is thus a method in which defined ink droplets below a limit value VLimit are deliberately generated during the print operation. Corresponding to the print utilization per nozzle, the ink regeneration in the nozzles can be adjusted in continuous print operation without performance loss. If the print utilization falls below a measure to be defined, the continuous regeneration of the ink in the nozzles ensures a basic utilization. Given this basic utilization the continuous regeneration is implemented at each nozzle insofar as it is not active for the print image generation at this point in time. In this case the print image generation prevails, meaning that the regeneration at this nozzle is interrupted. The regeneration can arise via a frequency via a frequency per nozzle as a regeneration parameter. The regeneration of a nozzle begins after (for example) a predetermined dead time of the respective nozzle after its last print usage.

Figure 2:
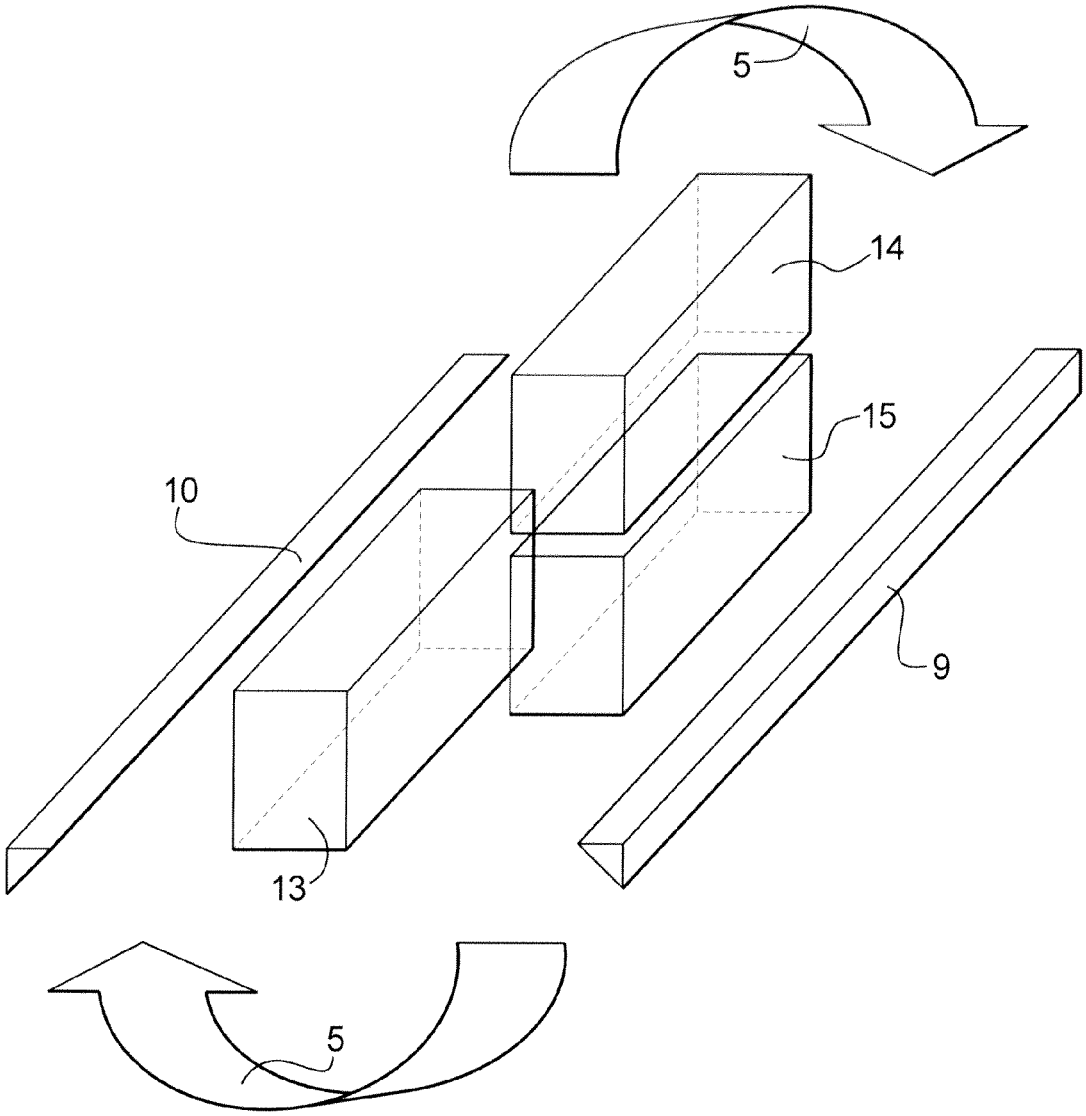
FIG. 2 is a principle representation of multiple print head bars with a suction device.

A print head 1 has been used in FIG. 1. In contrast to this, in a principle representation FIG. 2 shows the arrangement of print head bars 13, 14, 15 (with multiple respective print heads) and the suction device relative to one another. The suction device—comprising the overpressure chamber 9 on the one side and a suction chamber 10 on the other side of the print head bars 13, 14, 15—is arranged along the print head bars 13, 14, 15. The suction flow 5 from the overpressure chamber 9 to the suction chamber 10 and from the suction chamber to the overpressure chamber 9 is respectively shown as an arrow. The suction flow 5 is directed past the nozzles of the printing bars 13, 14, 15 in order to draw off the second ink droplets.

Although a preferred exemplary embodiment is shown and described in detail in the drawings and in the preceding specification, it should be viewed as purely exemplary and not as limiting the invention. It is noted that only a preferred exemplary embodiment is shown and described, and all variations and modifications that presently or in the future lie within the protective scope of the invention should be protected.

I claim as my invention:

1. A method to regenerate during operation ink in nozzles of at least one inkjet print head operating according to drop on demand in an inkjet print apparatus, comprising the steps of:

activating nozzles of said print head that generate print dots on a printing substrate such that the nozzles output first ink droplets of a predetermined volume in a direction towards the printing substrate;

activating nozzles that are not being currently used to generate print dots on the printing substrate such that they output at least one second ink droplet of smaller volume in comparison to the volume of the first ink droplets;

generating during at least said outputting of said second ink droplet a suction flow between the inkjet print head and the printing substrate of such strength that the second ink droplet is deflected so that the second ink droplet does not arrive at the printing substrate; and wherein print pauses for each nozzle are determined from a data stream for the inkjet print head that maps a print image, and if the print pause for the nozzle exceeds a predetermined value said nozzle is activated to output said at least one second ink droplet.

2. The method according to claim 1 wherein the suction flow is directed past the inkjet print head perpendicular to a path of the first ink droplets.

3. The method according to claim 2 wherein the suction flow is directed past the inkjet print head in a transport direction of the printing substrate.

4. The method according to claim 1 in which the suction flow is continuously directed past the inkjet print head.

5. The method according to claim 1 wherein said suction flow comprises a laminar suction flow directed past the inkjet print head.

6. A system to regenerate during operation ink in nozzles of at least one inkjet print head operating according to drop on demand in an inkjet print apparatus, comprising:

an overpressure chamber, a suction chamber, and a pump, the pump being connected via a conduit with the suction chamber and via a conduit with the overpressure chamber to generate a suction flow;

the overpressure chamber and the suction chamber being arranged adjacent to a print side of the inkjet print head such that said suction flow runs past the print side of the inkjet print head;

nozzles of the inkjet print head which generate print dots, based on signals from a printer controller, on a printing substrate by first ink droplets of a predetermined volume;

nozzles not being currently used to generate print dots on the printing substrate which output at least one second ink droplet of smaller volume in comparison to the volume of the first ink droplet based on signals from the printer controller, a strength of said suction flow being sufficient to deflect the second ink droplet so that the second ink droplet does not arrive at the printing substrate; and said printer controller determining from a data stream print pauses for each nozzle for the inkjet print head that maps a print image, and if the print pause for the nozzle exceeds a predetermined value activating said nozzle to output said at least one second ink droplet.

7. A method to regenerate during operation ink in nozzles of at least one inkjet print head operating according to drop on demand in an inkjet print apparatus, comprising the steps of:

activating nozzles of said print head that generate print dots on a printing substrate such that the nozzles output first ink droplets of a first volume in a direction towards the printing substrate;

activating nozzles that are not being currently used to generate print dots on the printing substrate such that they output at least one second ink droplet of smaller volume in comparison to the volume of the first ink droplets;

generating during at least said outputting of said second ink droplet a suction flow in a region between the inkjet print head and the printing substrate of such strength that the second ink droplet is deflected so that the second ink droplet does not arrive at the printing substrate, said suction flow being in a direction substantially transverse to a direction of the second ink droplet being output; and wherein print pauses for each nozzle are determined from a data stream for the inkjet print head that maps a print image, and if the print pause for the nozzle exceeds a predetermined value said nozzle is activated to output said at least one second ink droplet.

* * * * *